US006595366B1

(12) United States Patent
Brown

(10) Patent No.: US 6,595,366 B1
(45) Date of Patent: Jul. 22, 2003

(54) FOOD PACKAGE WHOSE LID HAS DESCENDING RIBS TO HELP HOLD FOOD PRODUCT AND TOPPINGS IN POSITION

(75) Inventor: Dean R. Brown, La Habra, CA (US)

(73) Assignee: PWP Industries, Vernon, CA (US)

( * ) Notice: Subject to any disclaimer, the term of this patent is extended or adjusted under 35 U.S.C. 154(b) by 0 days.

(21) Appl. No.: 09/562,824

(22) Filed: May 1, 2000

(51) Int. Cl.[7] ..... B65D 25/04; B65D 85/72

(52) U.S. Cl. ..... 206/551; 206/525; 220/522; 220/556; 426/124; 426/128

(58) Field of Search ..... 206/525, 541, 206/545, 551, 521.8, 521.9, 532, 807, 526; 220/574, 575, 557, 556, 521, 522, 4.23, 4.24; 426/94, 106, 107, 124, 127, 128; 30/114, 115; 83/870, 874; 99/537, 645

(56) References Cited

U.S. PATENT DOCUMENTS

| | | | | | |
|---|---|---|---|---|---|
| 1,448,938 | A | * | 3/1923 | Parrott | 30/114 |
| 1,743,980 | A | | 1/1930 | Samson | |
| 1,797,070 | A | * | 3/1931 | Brown | 30/114 |
| 3,099,567 | A | * | 7/1963 | Wallace et al. | 426/124 |
| 3,508,930 | A | * | 4/1970 | Bennett et al. | 426/124 |
| 3,556,338 | A | | 1/1971 | Wilkinson et al. | 220/60 |
| 3,592,349 | A | | 7/1971 | Baugh | 215/41 |
| 3,682,365 | A | | 8/1972 | Reifers et al. | 229/2.5 |
| 3,718,274 | A | | 2/1973 | Reifers et al. | 229/2.5 |
| RE29,415 | E | * | 9/1977 | Ricobene et al. | 206/545 |
| 4,202,464 | A | | 5/1980 | Mohs et al. | 220/339 |
| 4,256,240 | A | | 3/1981 | Woinarski | 220/306 |
| 4,290,248 | A | | 9/1981 | Kemerer et al. | 52/309.16 |
| 4,334,631 | A | | 6/1982 | Ballester | 220/306 |
| 4,373,636 | A | | 2/1983 | Hoffman | 206/551 |
| 4,408,698 | A | | 10/1983 | Ballester | 220/306 |
| 4,444,332 | A | | 4/1984 | Widén et al. | 220/306 |
| 4,545,487 | A | * | 10/1985 | Asmus | 206/545 |
| 4,570,818 | A | | 2/1986 | Borst et al. | 220/339 |
| 4,574,974 | A | | 3/1986 | von Holdt | 220/306 |
| 4,706,839 | A | | 11/1987 | Spence | 220/315 |
| 4,719,087 | A | | 1/1988 | Hanaway | 422/102 |
| 4,757,899 | A | * | 7/1988 | Magnussen, Jr. et al. | 206/521.9 |
| 4,834,237 | A | | 5/1989 | Henke et al. | 206/373 |
| 4,872,608 | A | * | 10/1989 | Lake | 206/521.8 |
| 4,874,083 | A | * | 10/1989 | Antoni et al. | 220/556 |
| 4,886,184 | A | | 12/1989 | Chamourian | 220/306 |
| 4,933,216 | A | | 6/1990 | Filbert et al. | 428/34.1 |
| 5,076,434 | A | * | 12/1991 | Hoffman, Jr. | 206/551 |
| 5,082,677 | A | * | 1/1992 | Bear | 426/124 |
| 5,273,174 | A | | 12/1993 | Fisher | 220/4.21 |
| 5,368,178 | A | | 11/1994 | Towns et al. | 215/317 |
| 5,405,009 | A | | 4/1995 | Hackenbracht | 206/470 |
| 5,405,627 | A | * | 4/1995 | Ito | 426/94 |
| 5,472,139 | A | * | 12/1995 | Valdman et al. | 229/906 |
| 5,507,429 | A | | 4/1996 | Arlin | 229/102 |
| 5,509,601 | A | * | 4/1996 | Drabick | 426/124 |
| 5,540,342 | A | | 7/1996 | Rathbun | 215/225 |
| 5,600,889 | A | * | 2/1997 | Marotta | 206/551 |
| 5,662,237 | A | * | 9/1997 | Cain | 426/127 |

(List continued on next page.)

FOREIGN PATENT DOCUMENTS

| | | |
|---|---|---|
| EP | 0420429 | 3/1991 |

*Primary Examiner*—Jim Foster
(74) *Attorney, Agent, or Firm*—Faegre & Benson LLP

(57) ABSTRACT

Package for storing a food item, such as pizza. The package includes a bottom on which the foot item is supported and a lid that closingly engages the bottom. The lid includes a plurality of elements that project downward from the lid toward the bottom in a pattern corresponding to an intended pattern of food slices. The ribs help to strengthen the package, hold the foot item in place inside the package, prevent migration of toppings from slice to slice, and may form indentations in the food item that serve as a template for cutting slices when the food item is removed from the container.

12 Claims, 8 Drawing Sheets

U.S. PATENT DOCUMENTS

| | | | | |
|---|---|---|---|---|
| 5,762,221 | A | | 6/1998 | Tobias et al. ..... 215/381 |
| 5,829,595 | A | | 11/1998 | Brown et al. ..... 206/600 |
| 5,866,181 | A | | 2/1999 | Hill ..... 426/107 |
| 5,866,183 | A | | 2/1999 | Small ..... 426/383 |
| 5,887,749 | A | * | 3/1999 | Schommer et al. ..... 220/575 |
| 5,897,015 | A | | 4/1999 | Sheahan ..... 220/281 |
| 5,979,687 | A | * | 11/1999 | Hayes et al. ..... 220/4.23 |
| 6,042,856 | A | * | 3/2000 | Sagan et al. ..... 220/575 |

* cited by examiner

FOOD PACKAGE WHOSE LID HAS DESCENDING RIBS TO HELP HOLD FOOD PRODUCT AND TOPPINGS IN POSITION

FIELD OF THE INVENTION

This invention relates to packaging for storing and transporting food products. More particularly, the invention relates to packing having a lid and a bottom and in which the package includes one or more structures to help prevent collapse of the container as well as to help hold the food product and its toppings in position during storage and transport.

BACKGROUND OF THE INVENTION

Fragile food items, such as pizza, cake, pie, pastries, bread, quiche, casserole, and the like, are often distributed in packaging to help protect such food items from the environment. A typical food package for fragile food items may be in the form of a cardboard box or in the form of a lid and container assembly that includes a removable lid, mounted onto a container bottom with a snap fit engagement. The lid and container may be separate pieces or formed from a single piece as is the case with a clam-shell (also referred to as a "hinge-lid") container. Such containers are widely known. These lid and container assemblies can be of a wide variety of shapes and sizes and may be used to store a wide variety of items. Due to their relatively low cost, lid and container assemblies made from polymeric materials such as polyester or polyethylene are particularly useful as packaging for foodstuffs. Various types of such assemblies have been described previously, e.g., in U.S. Pat. Nos. 4,256,240; 4,186,184; 5,540,342; 4,444,332; 4,408,698; 3,556,338; 5,368,178; 4,574,974; 4,334,631; and 3,592,349.

Food packages, if relatively large, may have panels that might tend to sag or otherwise distort during stacking, transport, and storage. Sagging panels is a problem, for instance, in packaging for cakes and pizzas. In the case of pizza, a distorted package panel can displace cheese and other pizza toppings, ruining the visual appeal of the pizza. In the case of cake, as another example, a distorted package can crack or smear icing and decorations. Accordingly, packaging for fragile food items often includes structural features to help prevent distortion of package panels.

For example, U.S. Pat. Nos. 5,509,601 and 5,542,540 show pizza packages that include central spacers to help support the cover panels of the packages. U.S. Pat. No. 5,480,031 shows a structural spacer for a pizza package that doubles as a tool for cutting slices. The spacer in U.S. Pat. No. 4,877,609 doubles as a food server. U.S. Pat. No. 4,700,843 shows a carton formed from cardboard in which a structural spacer is an integral part of the carton material. U.S. Pat. No. 3,180,739 shows a food package for cake whose lid incorporates a toothed strip. The teeth project into icing of the cake being stored in the package. U.S. Pat. No. 2,106,426 shows a package in which the lid includes arched members that overlie the food item and help stiffen the package.

Conventional structural stiffeners might prevent cover panels from sagging, but other problems remain. With some designs, the package contents as a whole are relatively free to move and shift within the package. Such shifting can easily damage cakes, pizzas, pastries and other delicate food items. Even if the food item as a whole does not shift, toppings on the food item might have a tendency to shift or migrate from one position to another. For example, pizza cheese and toppings might have a tendency to migrate or shift from one slice to another.

It would be desirable, therefore, not only to structurally reinforce a package as is done via the "pizza saver" reinforcements, but also to provide a package in which the packaged food item is held securely in place and toppings are restricted from migrating throughout the package.

SUMMARY OF THE INVENTION

The present invention relates to a package well-suited for fragile food items that includes elements in the package lid that not only structurally reinforce the lid, but also help hold packaged items in position and restrict migration of toppings within the package. The elements may also form indentations in the packaged food item, thus providing a template for cutting the food item into individual slices.

Accordingly, in one aspect, the present invention relates to a package for storing a food item, such as pizza. The package includes a bottom on which the foot item is supported and a lid that closingly engages the bottom. The lid includes a plurality of elements that project downward from the lid toward the bottom in a pattern corresponding to an intended pattern of food slices. The ribs help to strengthen the package, hold the foot item in place inside the package, prevent migration of toppings from slice to slice, and may form indentations in the food item that serve as a template for cutting slices when the food item is removed from the container.

BRIEF DESCRIPTION OF THE DRAWINGS

The above mentioned and other advantages of the present invention, and the manner of attaining them, will become more apparent and the invention itself will be better understood by reference to the following description of the embodiments of the invention taken in conjunction with the accompanying drawings, wherein.

DETAILED DESCRIPTION OF THE PRESENTLY PREFERRED EMBODIMENTS

Figure 1:
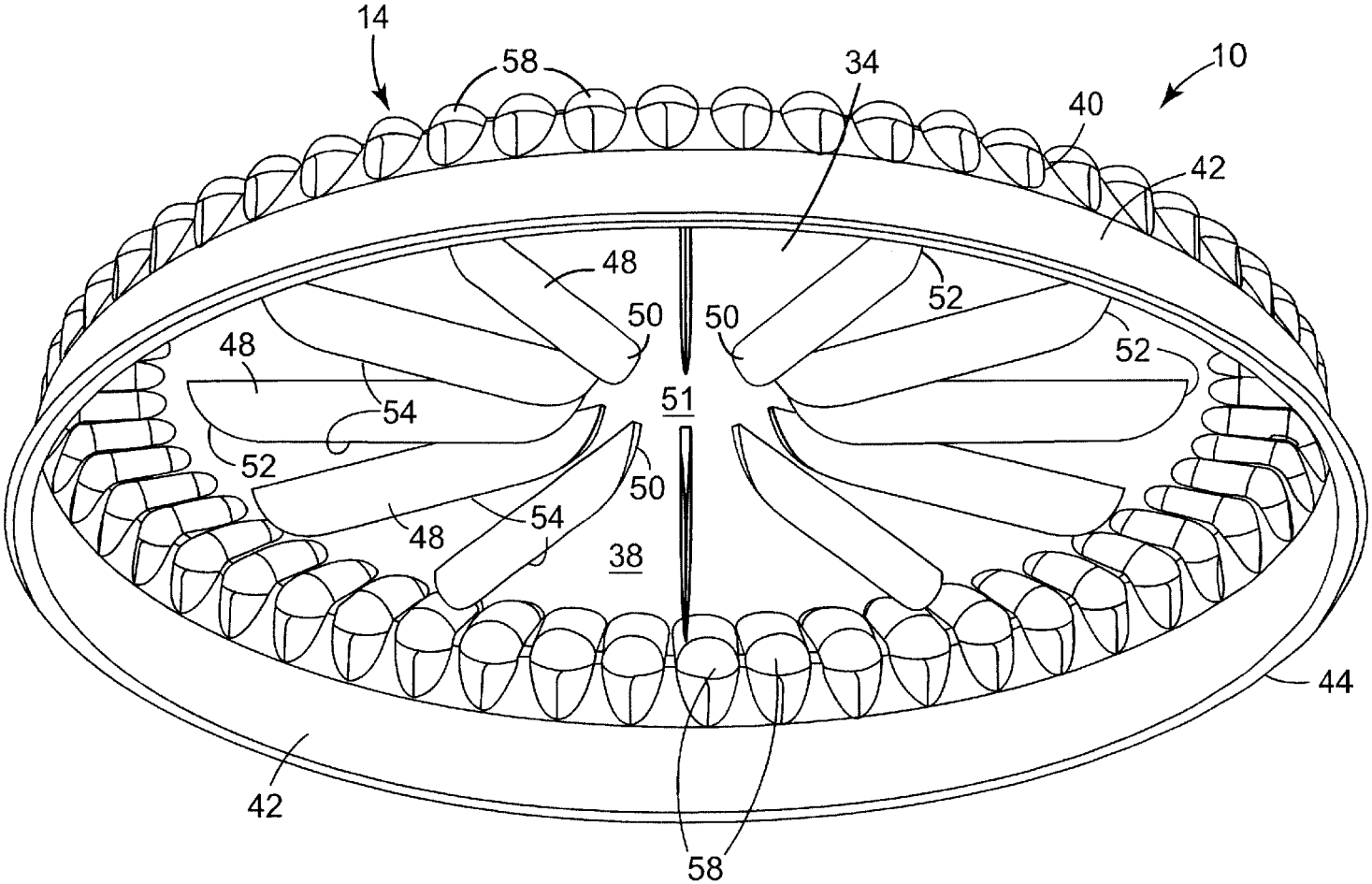
FIG. 1 is a perspective view looking up into one preferred embodiment of a lid of the present invention in which the lid is round-shaped for holding a pizza and has a radial array of descending ribs corresponding to a pattern of wedge-shaped pizza slices, and wherein the lid, for illustrative purposes is made from a clear, thermoplastic material.
Figure 2:
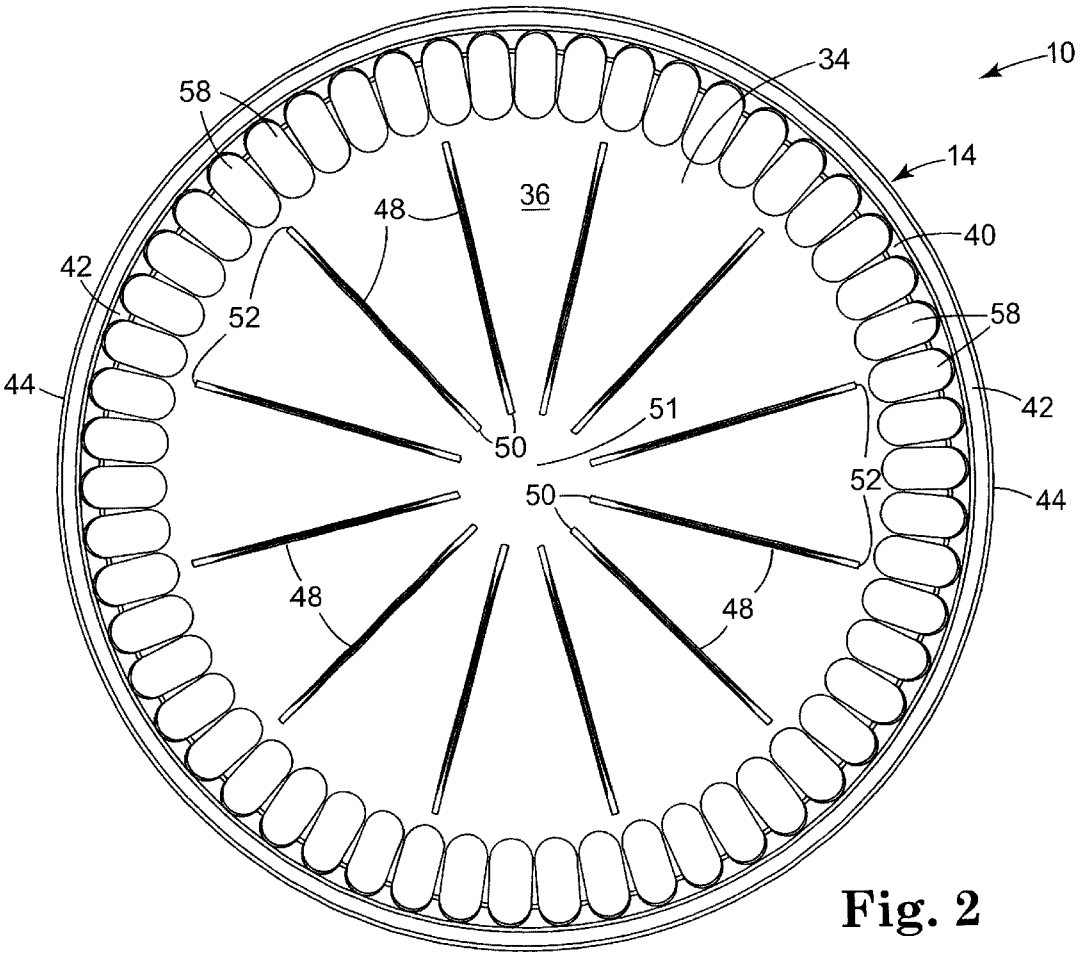
FIG. 2 is a top plan view of the lid of FIG. 1, in which the radial array of descending ribs is visible through the lid cover panel.
Figure 3:
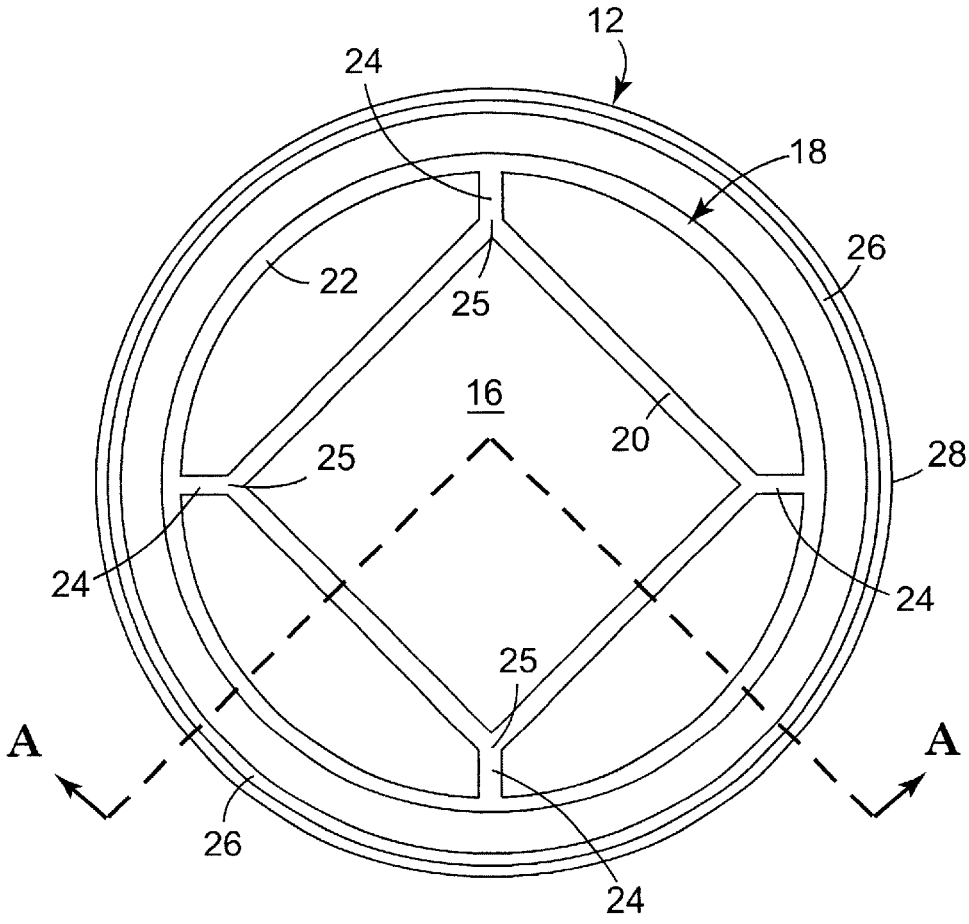
FIG. 3 is a schematic top plan view of a preferred bottom to be used with the lid of FIG. 1.
Figure 4:
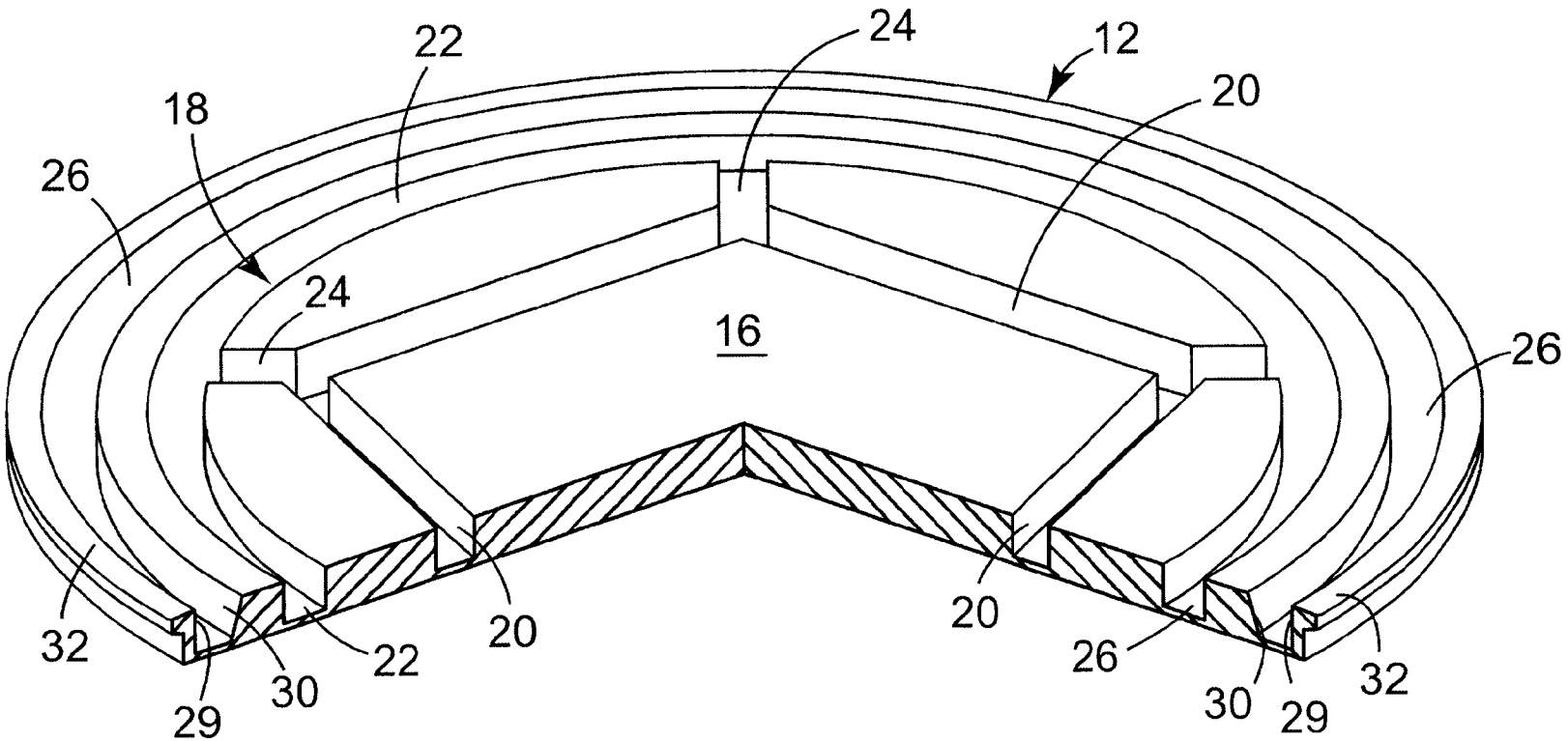
FIG. 4 is perspective view of the bottom of FIG. 3 shown in partial cross-section along line A—A of FIG. 3.
Figure 5:
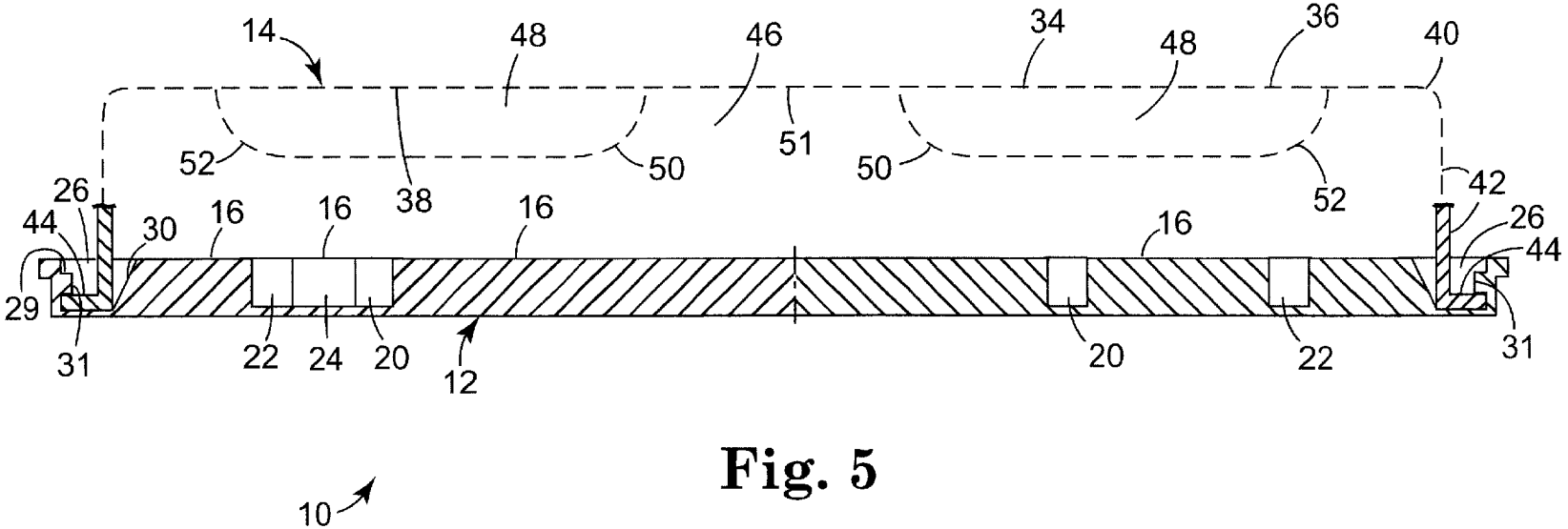
FIG. 5 is a side section view of a package of the present invention including the lid of FIG. 1 (shown for the most part in phantom) and the bottom of FIG. 3.

The embodiments of the present invention described below are not intended to be exhaustive or to limit the invention to the precise forms disclosed in the following detailed description. Rather the embodiments are chosen and described so that others skilled in the art may appreciate and understand the principles and practices of the present invention.

FIGS. 1–5 show one preferred embodiment of a package 10 of the present invention. For purposes of illustration, package 10 as shown is generally round in shape and is dimensioned for packaging a pizza pie. However, packages of the present invention can be any of a variety of shapes and can be used to store and transport a wide variety of food products. For example, in addition to pizza, packages of the present invention may also be used to transport and store bakery pie, cake, cookies, streudel, quiche, casserole, coffee cake, other pastries and baked goods, and the like. Depending upon the shape of such food items to be stored and/or transported, packages of the present invention may be round, oval, square, rectangular, triangular, hexagonal, pentagonal, trapezoidal, conical, and the like.

Package 10 generally includes bottom 12 and lid 14 that closingly engages bottom 12. In the preferred embodiment shown, this is accomplished with a snap-fit engagement. Although shown as separate pieces, bottom 12 and lid 14 may be formed as a single piece, e.g., in the form of a clan shell, if desired. Bottom 12 and lid 14 may be formed from a wide variety of materials such as paper, cardboard, polymer, cloth, aluminum, and the like. Preferably, each of bottom 12 and lid 14 is independently formed from a thermoplastic polymer such as polyethylene, polyester, high-impact polystyrene, polyurethane, combinations of these, and the like. In the preferred embodiment of package 10 as shown, each of lid 14 and bottom 12 is most preferably independently formed from a sheet of a thermoplastic polymer.

Bottom 12 as shown in this preferred embodiment is a generally round, planar platter having food support surface 16 on the interior face of bottom 12. Food product such as pizza (not shown) is supported upon food support surface 16 during storage and/or transport. Network 18 of grooves is advantageously formed in food support surface 16. Depending upon the manner in which network 18 is formed, the grooves of the network can form a pleasing design to enhance the appearance of package 10. For example, network 18 as shown is formed from a visually appealing combination of an inner square groove 20, an outer circular groove 22, and short interconnecting grooves 24 to join corners 25 of square groove 20 to outer circular groove 22.

Grooves 20, 22, and 24 of network 18 provides many advantages. Firstly, these grooves function as strengthening ribs, to help stiffen bottom 12. Additionally, when holding a hot item such as a pizza, network 18 provides a convenient well for holding condensation away from the pizza crust, thus helping to minimize the tendency of a hot pizza crust to get soggy when packaged on a bottom lacking such grooves.

Peripheral pocket 26 is formed around rim 28 of bottom 12 and is defined by sidewalls 29 and 30 and pocket bottom 12. Peripheral pocket 26 is dimensioned to operatively engage corresponding structure (defined below) of lid 14 with a snap-fit engagement. Peripheral flange 32 extends radially outward from rim 28 and helps to reinforce rim 28.

Lid 14 includes cover panel 34 having an external face 36 and internal face 38. At the outer periphery 40 of cover panel 34, sidewall 42 extends downward and terminates at an engagement portion in the form of rim 44 that allows lid 14 to engage peripheral pocket 26 of bottom 12 with a snap fit engagement. When rim 44 of lid 14 is press fit into peripheral pocket 26 of bottom 12, pocket 26 operatively traps rim 44 to accomplish snap fit engagement. When assembled, lid 14 and bottom 12 define chamber 46 for storing one or more food products (not shown).

A plurality of elements in the form of ribs 48 project downward from internal face 38 of lid 14. Ribs 48 project downward in a pattern corresponding to the intended pattern of food slices in which the food product(s) being stored is/are to be divided when served. For example, in the embodiment of package 10 shown, package 10 is dimensioned for storing a round pizza that may be pre-sliced, or sliced at the time of service, into a plurality of wedge-shaped slices. In accordance with this intent, ribs 48 are present in a radial pattern corresponding to such wedge-shaped slices. Lid 14 of package 10 as illustrated includes eight radially-oriented ribs 48 corresponding to a pizza have eight wedge-shaped pizza slices. More or less ribs could be used as desired, however, depending upon the number of slices to be obtained from the pizza. The width of ribs 48 from top to bottom (that is, from cover panel 34 to lower edge 54) may vary depending upon the thickness of the food item being secured.

Ribs 48 provide many benefits. First, ribs 48 function as a "pizza saver" to help prevent lid 14 from sagging onto and thereby damaging the top of the food product stored inside package 10. Additionally, when a food item is stored inside package 10, and lid 14 is secured to bottom 12, ribs 48 help to hold the entire pizza in position so that the pizza does not shift or slide inside package 10. Ribs 48 also form a physical boundary between pizza intended slices to help prevent pizza toppings from shifting from one slice area to another. As another advantage, if the pizza being stored was not pre-sliced prior to being packaged, ribs 48 can also be sized so as to form indentations in the top of the pizza, thus providing a template for cutting slices.

Figure 6:
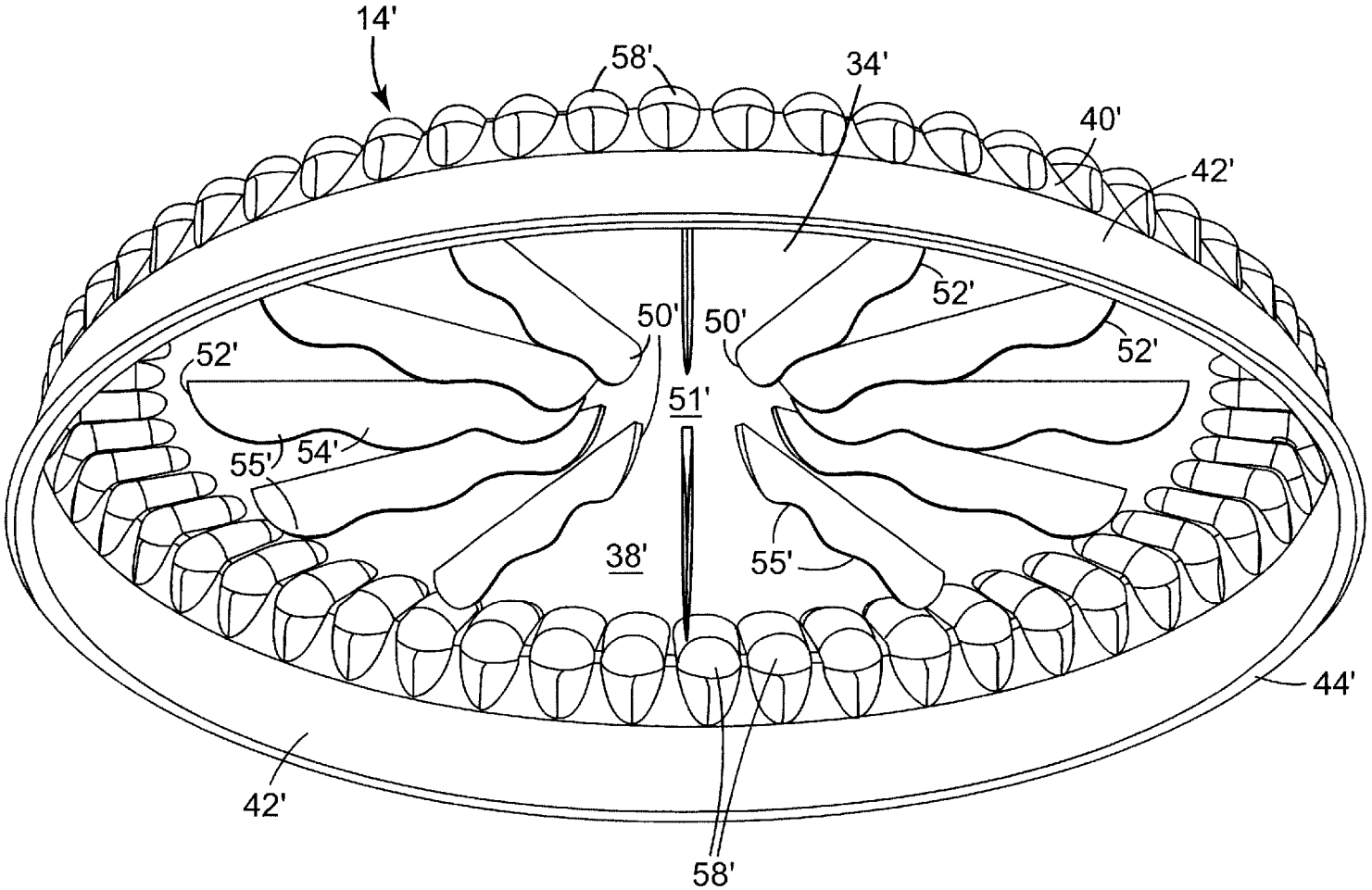
FIG. 6 is a perspective view looking up into an alternative embodiment of a lid of the present invention in which the lower edges of the descending ribs are undulated for enhanced gripping of the food item to be stored.
Figure 7:
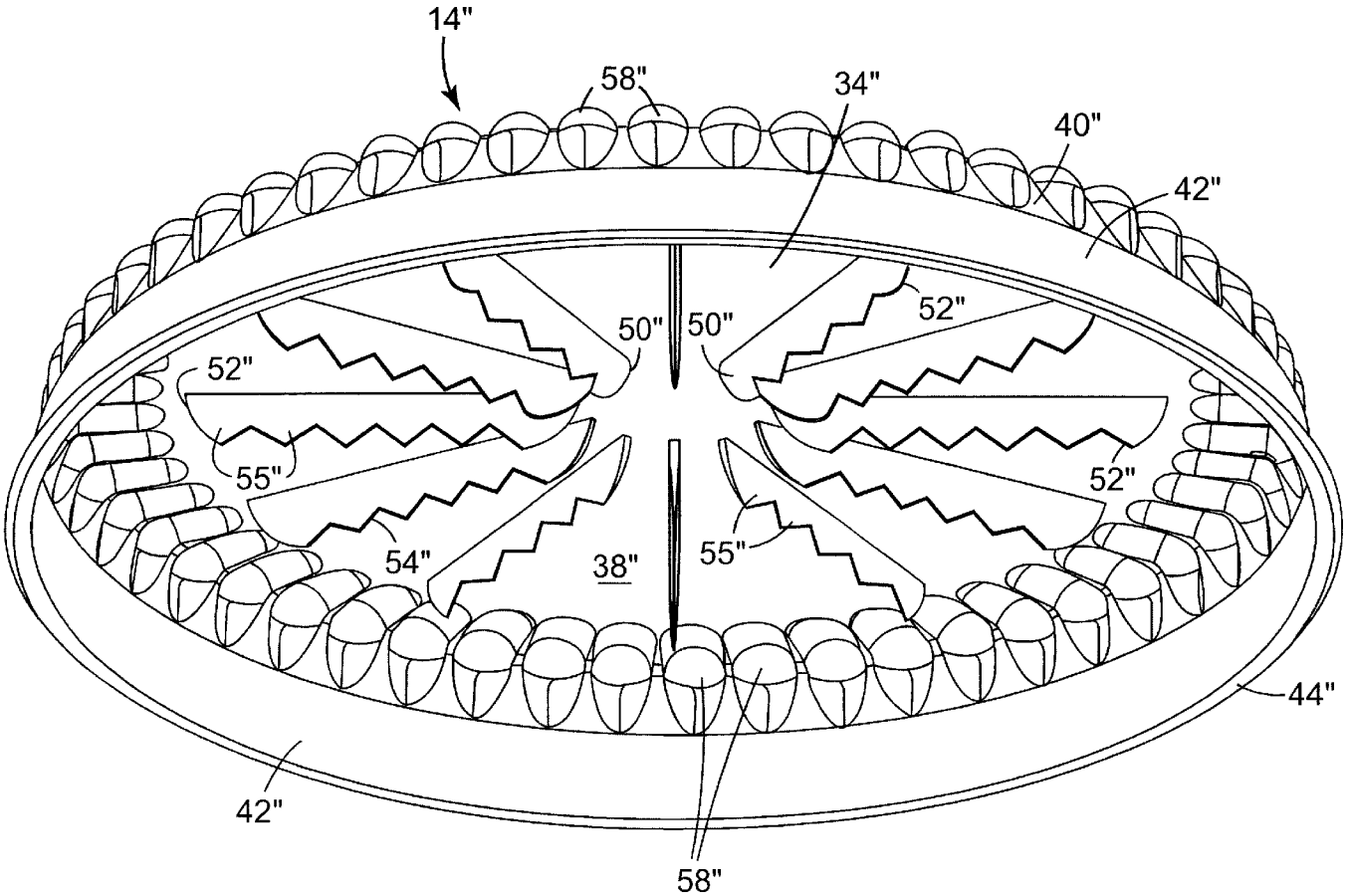
FIG. 7 is a perspective view looking up into another alternative embodiment of a lid of the present invention in which the lower edges of the descending ribs are toothed for enhanced gripping of the food item being stored.

In the embodiment of package 10 shown in FIGS. 1–5, ribs 48 extend radially from a first end 50 relatively proximal to central region 51 of lid 14 to second end 52 relatively distal from region 51 of lid 14. Respective lower edges 54 interconnect each first end 50 to its corresponding second end 52. As shown, lower edges 54 are substantially linear and ends 50 and 52 are generally rounded or otherwise curvilinear. Other configurations may be used as desired. For example, FIG. 6 shows an embodiment of a lid 14' that is identical to lid 14 of FIGS. 1–5, except that lower edges 54' of ribs 48' undulate in a wave-like pattern. In this approach, peaks 55' of lower edges 54' may project downward into the pizza being stored for enhanced gripping action. Along these line, FIG. 7 shows another similar embodiment in which lower edges 54" on ribs 48" have peaks 55" that may also project downward into the pizza being stored for enhanced gripping action.

Referring again to FIGS. 1–5, to enhance the appearance of package 10, either lid 14 or bottom 12 may include one or more decorative features. For example, a plurality of decorative bead-shaped elements 58 are distributed around outer periphery 40 of lid 14 to help provide lid 14 with a more pleasing appearance. Depending upon the intended use, the appearance of package 10 may also be enhanced by choosing to form lid 14 or bottom 12 from materials of one or more colors. For example, in one pleasing product design, lid 14 is formed from a clear, transparent polymer material to allow the food product inside package 10 to be easily viewed, while bottom 12 may be formed from a different, colored polymer material. Exterior face 36 of cover panel 34 also provides a convenient surface to affix decorative graphics, e.g., in the form of one or more labels, decals, or the like, to further enhance the appearance of package 10.

Depending upon how long a food product is to be stored in package 10 and the manner by which a food product might be displayed to potential consumers, it may be desirable to more securely attach lid 14 to bottom 12. If this is desired, a band of shrink-wrap material, or one or more tapes, can be easily used to more securely attach lid 14 to bottom 12.

Figure 8:
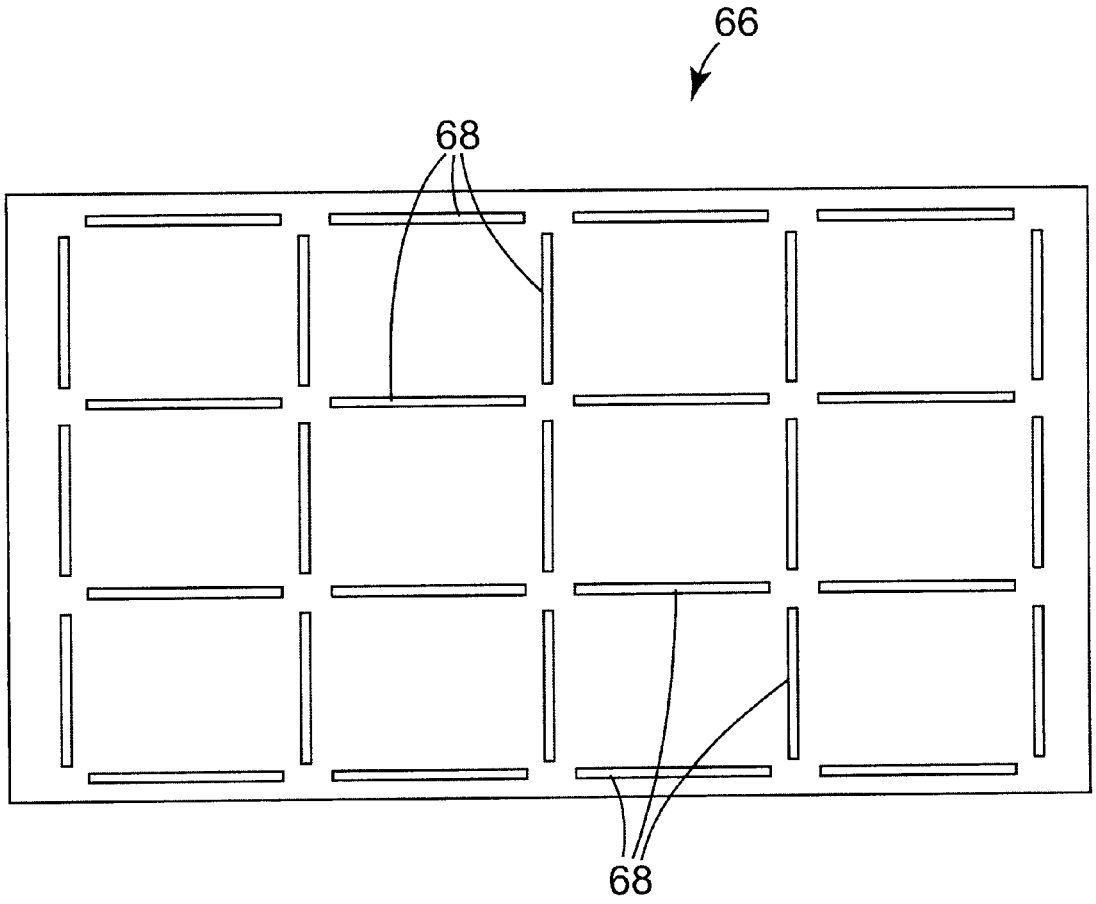
FIG. 8 is a schematic plan view of the interior surface of the cover panel of an alternative lid embodiment of the present invention, wherein a plurality of ribs descend downward from the lid in a rectangular pattern corresponding to a rectangular pattern of food slices.

The embodiment of package 10 as shown in FIGS. 1–5 is well-suited for storing and transporting round pizza that pre-sliced, or intended to be sliced, into a plurality of wedge-shaped slices. However, the principles of the present invention may be used in connection with other food items and other slice patterns. For example, FIG. 8 shows an alternative embodiment of a lid 66 of the present invention in which lid 66 would be part of a package for storing and/or transporting a rectangular food item, such as a cake, pizza or the like, that is sliced, or will be sliced, into a plurality of rectilinear slices. In accordance with this intent, a plurality of ribs 68 descend from lid 66 in a rectilinear pattern corresponding to the desired slice pattern.

Other embodiments of this invention will be apparent to those skilled in the art upon consideration of this specification or from practice of the invention disclosed herein. Various omissions, modifications, and changes to the principles and embodiments described herein may be made by one skilled in the art without departing from the true scope and spirit of the invention which is indicated by the following claims.

What is claimed is:

1. A package for storing a food item comprising:

a bottom on which the food item is supported;

a lid comprising a top portion and a side portion that releasably engages the bottom; and a plurality of divider elements attached to and extending along a substantial portion of an internal face of the top portion of the lid, and projecting downward from the top portion toward the bottom when the lid is engaged with the bottom, each divider element radially extending toward the side portion, the divider elements comprising a radial pattern extending outward from a central region of the top portion and generally corresponding to a pattern of wedge-shaped pieces of the food item, and the divider elements being separated by a portion of the top portion.

2. The package of claim 1 wherein at least a portion of the elements comprise a substantially linear lower edge.

3. The package of claim 1 wherein at least a portion of the elements comprise a toothed lower edge.

4. The package of claim 1 wherein at least a portion of the elements comprise a substantially curvilinear lower edge.

5. The package of claim 1 wherein at least a portion of the elements comprise a lower edge in which at least a portion of the lower edge is undulated.

6. The package of claim 1 wherein the plurality of divider elements project downward from the top portion of the lid toward the bottom to form indentations in the food item, when the lid is engaged with the bottom.

7. The package of claim 1 wherein the lid forms a snap-fit relationship with the bottom.

8. The package of claim 1 wherein the food product comprises a pizza.

9. The package of claim 1 wherein the elements are integrally formed with the lid.

10. A package for storing a food item comprising:

a bottom on which the food item is supported;

a lid comprising a top portion and a side portion that releasably engages the bottom; and a plurality of divider elements attached to an internal face of the top portion of the lid and projecting downward from the top portion toward the bottom when the lid is engaged with the bottom, the divider elements comprising a radial pattern extending outward from a central region of the top portion, the divider elements being separated by a portion of the top portion, and at least a portion of the divider elements comprising a lower edge in which at least a portion of the lower edge includes an undulation extending toward and away from the lid.

11. A package for storing a food item comprising:

a bottom having a generally planer surface on which the food item is supported;

a lid comprising a top portion and a side portion that releasably engages the bottom; and a plurality of divider elements attached to an internal face of the top portion of the lid and projecting downward from the top portion toward the bottom when the lid is engaged with the generally planar bottom, the divider elements comprising a generally rectangular pattern, the divider elements being arranged along each side of rectangular pieces of the food item.

12. The package of claim 11 wherein the lid comprises a single continuous compartment.

* * * * *